US005192196A

United States Patent [19]

Gettel

[11] Patent Number: 5,192,196

[45] Date of Patent: Mar. 9, 1993

[54] FLOW CONTROL ORIFICE FOR PARALLEL FLOW FLUID SUPPLY TO POWER STEERING GEAR

[75] Inventor: Roger W. Gettel, Bloomfield Hills, Mich.

[73] Assignee: Ford Motor Company, Dearborn, Mich.

[21] Appl. No.: 667,123

[22] Filed: Mar. 11, 1991

[51] Int. Cl.[5] ..... F04B 49/00

[52] U.S. Cl. ..... 417/300

[58] Field of Search ..... 417/300, 302, 307; 165/177

[56] References Cited

U.S. PATENT DOCUMENTS

| | | | |
|---|---|---|---|
| 4,289,454 | 9/1981 | Iwata | 417/300 |
| 4,429,708 | 2/1984 | Strueh | 417/300 |
| 4,470,762 | 9/1984 | Wendler | 417/283 |
| 4,470,764 | 9/1984 | Anderson et al. | 417/299 |
| 4,470,765 | 9/1984 | Hegler | 417/299 |
| 4,473,128 | 9/1984 | Nakayama et al. | 180/140 |
| 4,485,883 | 12/1984 | Duffy | 180/142 |
| 4,561,521 | 12/1985 | Duffy | 180/142 |
| 4,570,735 | 2/1986 | Duffy | 180/142 |
| 4,609,331 | 9/1986 | Duffy | 417/293 |
| 4,691,619 | 9/1987 | Kervagoret | 91/459 |
| 4,714,413 | 12/1987 | Duffy | 417/293 |
| 4,741,675 | 5/1988 | Bowden | 417/300 |
| 4,768,605 | 9/1988 | Miller et al. | 417/300 |

*Primary Examiner*—John J. Vrablik
*Assistant Examiner*—Alfred Basichas
*Attorney, Agent, or Firm*—Frank G. McKenzie; Roger L. May; Raymond L. Coppiellie

[57] ABSTRACT

A power steering pump includes a housing defining an opening containing a sliding vane rotor, a cam ring and pressure plates located at each axial side of the rotor, inlet ports connected to a source of low pressure fluid, and outlet ports connected to a power steering system. The pressure control valve opens and closes an orifice of constant size connecting the pump outlet to a power steering gear. An electronically variable orifice arranged in parallel with the fixed orifice connects the pump and outlet to the power steering gear. When the control valve opens sufficiently, the pump outlet is connected to the inlet through a diffuser arranged to draw low pressure fluid into a high velocity stream of bypass fluid. An orifice fitting, located in a flow control valve that directs flow from a pump outlet port through the orifice aperture to an automotive power steering gear, diverts that flow to a bypass port connected to the pump inlet. The orifice aperture is offset radially from the axis of the valve.

14 Claims, 6 Drawing Sheets

FLOW CONTROL ORIFICE FOR PARALLEL FLOW FLUID SUPPLY TO POWER STEERING GEAR

BACKGROUND OF THE INVENTION

1. Field of the Invention

This invention relates to flow rate control of hydraulic pumps, especially those used in automotive power steering systems. The invention pertains particularly to an orifice fitting having an aperture connecting the pump discharge and a load such as a steering gear.

2. Description of the Prior Art

The flow control system of an automotive power steering system ideally increases the flow rate delivered to the steering gear linearly with pump speed over a low speed range extending from zero to about 700–800 rpm. Thereafter as pump speed increases, flow rate is held constant or nearly constant by diverting flow from the steering gear to a bypass port leading to the pump inlet.

Conventionally a flow control valve includes a spool slidable in a cylinder, a port connected to the pump outlet, a bypass port, a spring urging the spool to close the bypass post, an orifice connecting the pump outlet and the steering gear, and a passage connecting steering system pressure downstream from the orifice to an end of the spool. A pressure force develops on the spool due to this feedback pressure tending to combine with the spring force to close the bypass port. These spool forces are opposed by a force on the spool resulting from pressure upstream from the orifice tending to open the bypass port.

Therefore, as pump flow rate increases, the pressure differential across the orifice increases and the spool moves in the valve cylinder against the spring force to open progressively the bypass port. As the bypass port opens, system pressure decreases because flow is diverted from the steering gear directly to the pump inlet.

Flow to the steering gear can be reduced to a constant flow rate at the highest range of pump speed, in comparison to a higher constant flow rate at a lower speed range, by use of an orifice whose effective flow area is adjusted according to flow rate by a drooper pin. Conventionally a drooper pin is carried on the valve spool and includes at least two concentric areas of unequal size connected by a transition zone. The pin is drawn through the orifice aperture as the spool moves in the valve in response to differential pressure. The smaller pin area produces a smaller pressure drop for a given flow rate, the larger pin area produces a larger differential pressure across the orifice.

Feedback pressure on the valve spool is lower when the pressure drop is greater. Therefore, when the larger pin area enters the aperture, the bypass port is opened more fully than when the smaller area is in the aperture. Consequently, flow is diverted more fully from the steering gear to the pump inlet. A drooper pin permits multiple flow rates to the steering gear over ranges of pump speed.

However, a drooper pin requires precise dimensional tolerance control among the orifice aperture and drooper pin areas, and close correlation between the effective size of the orifice aperture, spool position and flow rate to the steering gear. Close tolerance machining is required. High cost and complexity in machining or otherwise forming the pin result necessarily from use of a drooper pin.

Various techniques for controlling operation of the flow control valve have been developed. For example, U.S. Pat. No. 4,289,454 describes a vane pump having two outlet ports, one port being closed after the flow rate exceeds a predetermined magnitude due to an increase in speed of the rotor. The excess fluid normally passing through one of the outlet ports is returned to the pump inlet to increase the fluid flow rate to the steering gear during high speed conditions.

U.S. Pat. No. 4,470,762 describes a pump having a control that bypasses flow from the pump between a cam ring and thrust plate. A spring opens the bypass passage and a pressure plate closes the bypass passage when system pressure rises. The pump control described in U.S. Pat. No. 4,470,764 includes a spring operating on a valve spool to open bypass flow and biased by system pressure to reduce bypass flow. In the vane pump of U.S. Pat. No. 4,470,765, output flow is partially bypassed through a flow control valve. The valve is operated by system pressure to close bypass passages as system pressure rises, thereby increasing flow to the power steering system.

More recently, power steering systems include electronically variable orifices that are opened and closed in response to vehicle speed and steering wheel speed so that the flow rate to the steering gear from the pump outlet is high when the required steering assist is high, particularly at low vehicle speed, and is low when the required steering assist is low, particularly at high vehicle speed and low steering wheel speed. An example of a power steering system controlled in this way is described in U.S. Pat. No. 4,473,128 in which a bypass valve directs a portion of the fluid flow from the pump to the steering gear in response to vehicle speed and angular velocity of the steering wheel. The position of the bypass valve is controlled by a solenoid, energized and deenergized on the basis of control algorithms executed by a microprocessor. The flow control valve described in U.S. Pat. No. 4,691,619 is also operated by a solenoid, which is energized and deenergized in response to vehicle speed. A pressure modulated slide valve is hydraulically piloted by a solenoid-operated valve. Fluid flow to the steering gear is controlled entirely hydraulically in response to vehicle speed and demand requirements represented by the steering gear input.

U.S. Pat. No. 4,485,883 describes a power steering system having a bypass valve controlling the flow rate of fluid directed from the pump outlet to the pump inlet and a constant flow valve for regulating the flow of bypass fluid. This control system reduced the flow rate to the steering gear during steering maneuvers at high speed and increases the flow rate at low speed and during parking maneuvers.

A similar object is realized with the power steering systems described in U.S. Pat. Nos. 4,561,561; 4,570,735. A vehicle speed sensitive valve operates to deactivate a conventional flow control bypass valve by eliminating differential force on the flow control valve at speeds greater than a predetermined value. U.S. Pat. No. 4,714,413 describes a power steering system of this type. Another control system of this type employing a solenoid-operated vehicle speed sensitive valve in combination with a conventional flow control bypass valve is described in U.S. Pat. No. 4,609,331.

SUMMARY OF THE INVENTION

The orifice fitting of the present invention is located in a flow control valve that directs flow from a pump outlet port through the orifice aperture to an automotive power steering gear and diverts that flow to a bypass port connected to the pump inlet. The fitting contains a cylindrical aperture of fixed size having one end located adjacent the bypass port and the opposite end communicating through a feedback passage to the spool of the control valve. The orifice aperture is offset radially from the axis of the valve.

When the bypass port is closed, a steep, localized pressure gradient, from high pressure at the pump outlet upstream of the aperture to low pressure in the bypass port, results. The steep gradient is located near the end of the aperture at the corner of the orifice fitting adjacent the bypass port. The slope of the pressure gradient decreases and the size of the zone containing the gradient expands as the bypass port opens.

As the bypass port opens, the size of the gradient zone expands across the end of the aperture. As this occurs, pressure at the aperture end decreases below pump outlet pressure, the pressure at the aperture end when the bypass port is closed. This drops pressure in the feedback line leading from the downstream end of the orifice to the valve spool, reduces the magnitude of force on the spool opposing pump outlet pressure force on the spool, and causes the spool to further open the bypass port.

The location of the orifice aperture near the bypass valve can be located as required so that a suitable pressure in the pressure gradient zone is present at the aperture end. That location is determined so that flow rate to the steering gear is kept virtually constant or with little change at pump speeds above a predetermined speed. Preferably before the bypass port opens, flow rate to the steering gear changes in proportion to pump speed. Thereafter, flow to the steering gear is coordinated with the size of the bypass port opening in response to pressure at the pump outlet and the pressure drop across the orifice aperture.

DESCRIPTION OF THE PREFERRED EMBODIMENT

Figure 1:
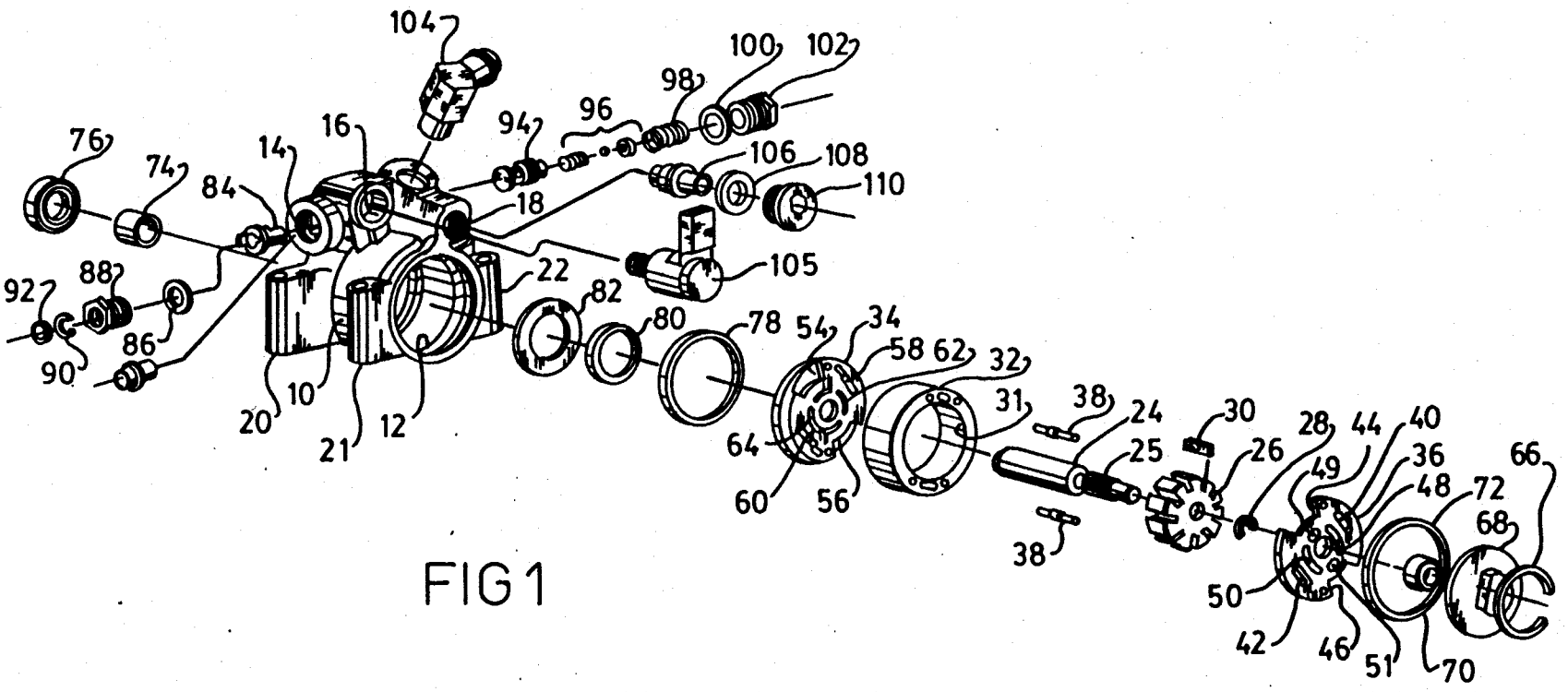
FIG. 1 is an isometric view of a power steering pump, showing its pumping components and control elements spaced axially from adjacent components.

A rotary vane hydraulic power steering pump according to this invention supplies pressurized fluid to an automotive vehicle steering gear. The pump includes a housing 10 defining a cylindrical space containing the pumping elements, a bore 14 containing a flow control valve and related components, a bore 16 communicating with bore 14 and containing an electronically variable orifice, and a diffuser passage 18. The housing includes at least three bosses 20–22, each having a cylindrical hole adapted to receive a mechanical attachment such as a bolt, which can be threaded directly to the engine block of the vehicle. In this way, the conventional bracket usually used to support a power steering pump located in position to be driven by a V-belt from the engine crankshaft can be eliminated.

The components that pump hydraulic fluid from a reservoir to the steering gear are rotatably supported on a shaft 24, driven by an endless drive belt from an engine and rotatably connected by a splined connection to a rotor 26 fixed in position on the shaft by a snap ring 28. The rotor has ten radially sliding vanes, held in contact with the inner surface of a cam ring 32 having two arcuate zones extending angularly in rise or inlet quadrants and two zones of lesser radial size extending angularly in fall or outlet quadrants mutually separated by the inlet quadrants. A lower pressure plate 34 and an upper pressure plate 36 are fixed in position radially with respect to the cam 32 by alignment pins 38. Formed through the thickness of the upper pressure plate are arcuate outlet ports 40, 42 communicating with an outlet port opening to the flow control valve bore 14, inlet ports 44, 46 and arcuate passages 48, 50 for use in cold starting priming. The lower pressure plate has inlet ports 56, 54 formed through its thickness, outlet ports 58, 60 and arcuate flow passages 62, 64 hydraulically connected to passages 48, 50.

A wire retaining ring 66 seats within a recess at the end of the pump housing to hold in position a pump cover 68. Bushing 70 supports shaft 24 on a recess in the inner surface of the cover. Seal 72 prevents the passage of hydraulic fluid.

The opposite end of the rotor shaft is supported rotatably in a bushing 74, which is supported on the housing; a shaft seal 76 prevents flow of hydraulic fluid from the pumping chambers. Located adjacent the lower pressure plate on the opposite side from the cam are an inner seal 78, an outer seal 80, and a Belleville spring 82, which develops an axial force tending to force mutually adjacent surfaces of the various components into abutting contact.

Located within bore 14 are a discharge port orifice 84, seal 86, connector 88, a retaining ring 90, and O-ring seal 92. Also located within bore 14 is a relief valve spool 94, a coiled compression spring, ball, ball seat 96 and a larger compression spring 98 urging spool 94 toward a high speed position where the flow control valve is open. A Teflon seal 100 and plug 102 close the adjacent end of the bore mechanically and hydraulically. A tube assembly 104 connects a tube carrying fluid from the steering gear to the pump housing, through which it passes in suitable ports to the pumping chamber. An actuator assembly 105 for an electronically variable orifice is engaged by screw threads in bore 16.

A system for supercharging fluid at the pump inlet includes a diffuser 106, seal 108 and plug 110 engaged with screw threads formed in bore 18 of the housing.

Figure 2:
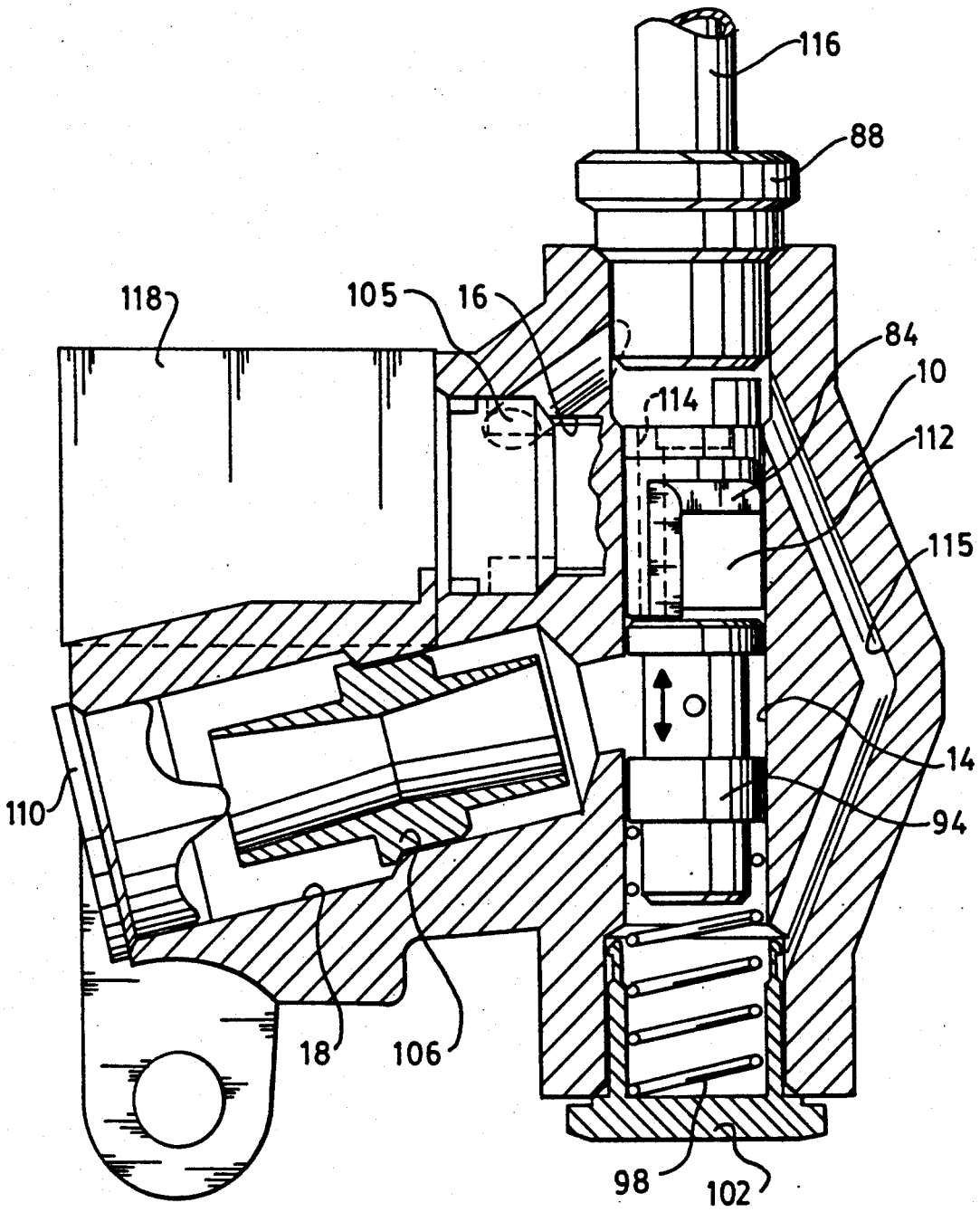
FIG. 2 is a cross section through the power steering relief valve and adjacent housing area with the components disposed in the low speed position.

Referring now to FIG. 2, the outlet ports in the pressure plates are connected through port 112 to bore 14 in which relief valve 94 is located. Orifice 84 has an axially directed passage 114, which continually connects port 112 to the pressure tube 116, which carries high pressure hydraulic fluid to the steering gear from the pump.

Figure 4:
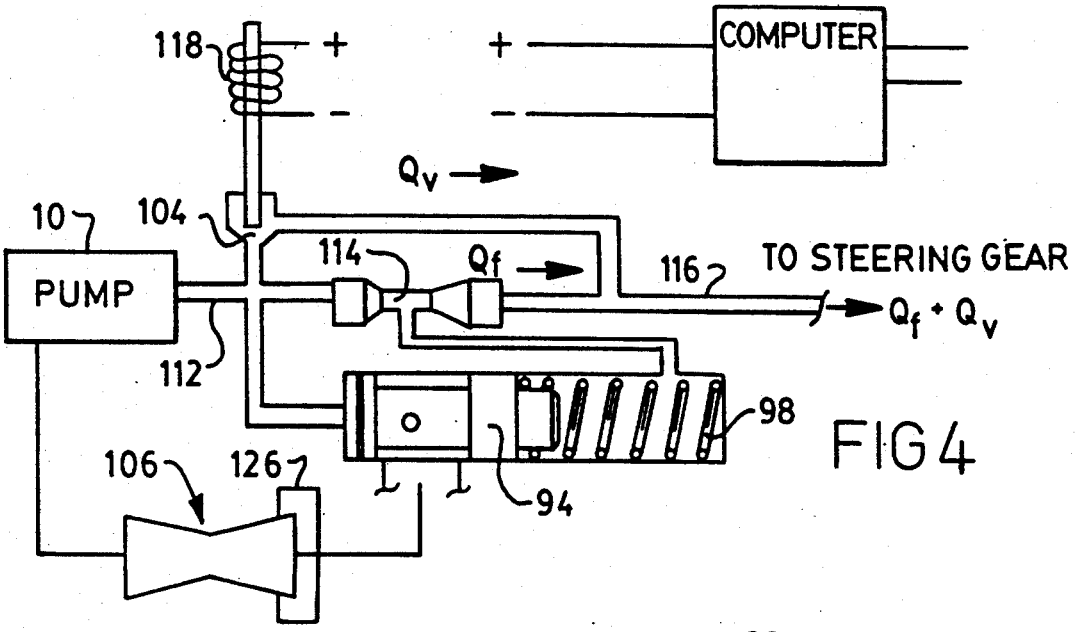
FIG. 4 is a schematic diagram showing the parallel flow arrangement of a constant area orifice and variable area orifice between the pump outlet and the steering gear.

Electronically variable orifice assembly 105 includes a solenoid 118, operated by an output signal produced by a microprocessor accessible to control algorithms and input signals produced by speed sensors, which produce signals representing the speed of the vehicle and steering wheel. As these control algorithms are executed, an electronically variable orifice 105 opens and closes communication between port 112 and pressure tube 116. In this way, the fixed orifice of passage 114 and the electronically variable orifice 105 are in parallel flow arrangement between passage 112 and the outlet to the steering gear. Therefore, the flow rate through passage 114 can be adjusted through operation of the pressure relief valve independently and without affecting the position of the electronically variable orifice. FIG. 4 illustrates the arrangement of the fixed orifice and variable orifice between the pump outlet and steering gear.

The flow rate through port 112 is proportional to the speed of the pump shaft 24 and to the speed of the engine to which that shaft is connected. An orifice aperture 114 produces a pressure drop relative to pressure at port 112. Pressure downstream of aperture 114, the steering system pressure, is fed back in passage 115 to the end of the spool contacted by spring 98. A force resulting from the feedback pressure adds to the spring force on the spool. When pump speed increases, hydraulic system pressure in port 112 increases, thereby forcing spool 94 against the effect of compression spring 98 and the feedback pressure force. This action opens passage 114 to the steering gear and adds the flow through passage 114 to the flow through the electronically variable orifice from port 112. System pressure carried in passage 115 to the end of spool 94 opposes the pressure force on the spool tending to open the valve.

Figure 3:
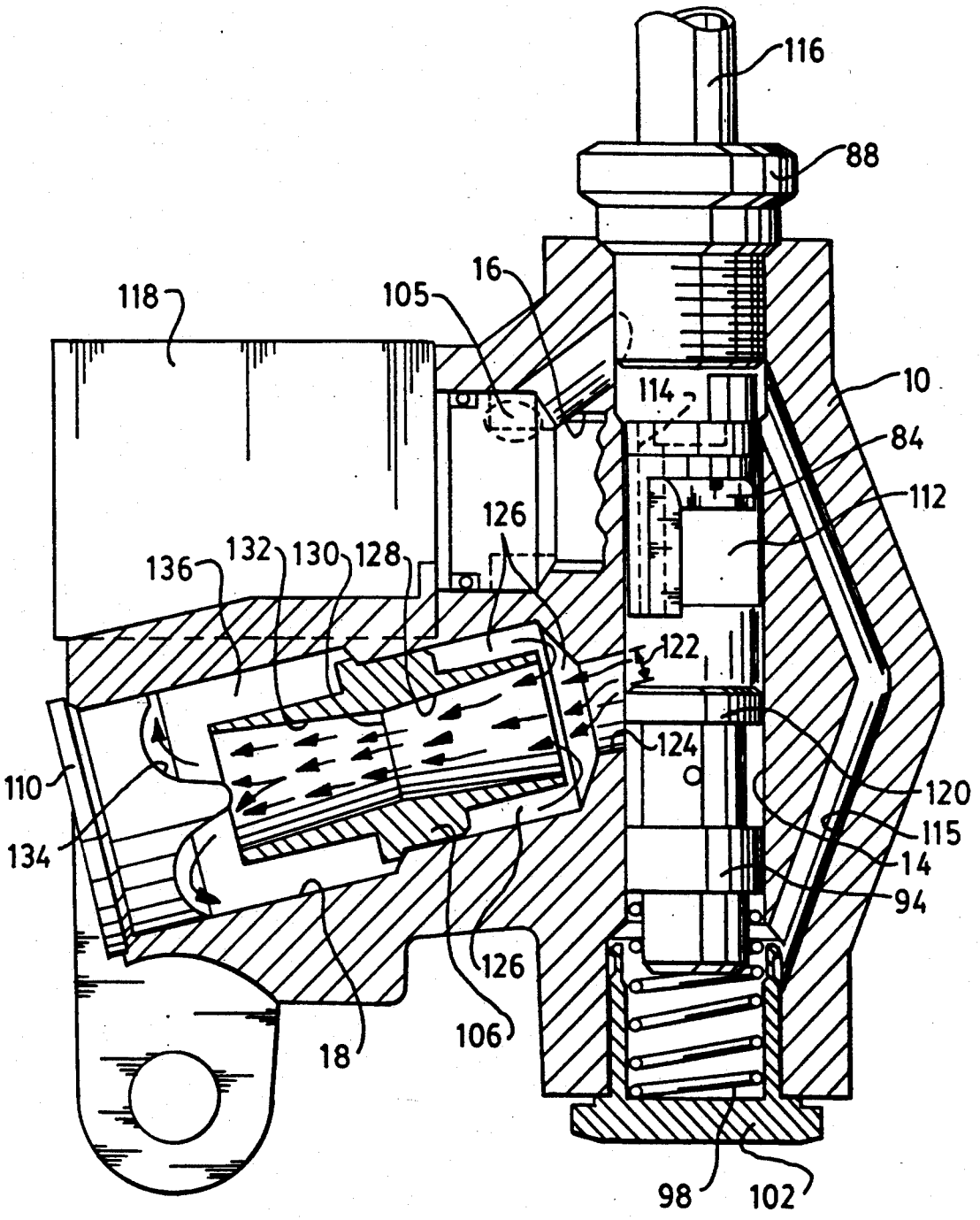
FIG. 3 is a cross section through the power steering relief valve and adjacent housing with the components disposed in the high speed position.

FIG. 3 shows spool 94 in a more fully opened position from that of FIG. 2, where land 120 opens the axial end of passage 114. When valve spool 94 moves to the high speed position of FIG. 3, bypass port 122, a passage that connects bore 114 and inlet passage 124 to the diffuser 106, opens. As relief valve 94 opens, the size of the bypass port 122 increases progressively, thereby increasing the flow rate through the diffuser. The annular space 126 between diffuser 106 and bore 18 and the cylindrical space between bypass port 122 and the diffuser entrance communicates with low pressure fluid in a reservoir or a return line, such as the line connected to fitting 104, returning fluid to the inlet ports and the pumping chambers, the space between the rotor vanes, rotor and inner surface of the cam. When bypass port 122 opens, fluid at an extremely high flow rate enters space 126 and contracting portion 128 of the diffuser. This action produces a jet pump, in which the stream of low pressure fluid from space 126 and high pressure fluid mix. The combined stream increases in velocity in the diffuser up to the diffuser throat 130 due to the reduction in cross sectional area along the length of portion 128. The combined fluid stream expands after passing the throat along the length of the expansion portion 132, the diffuser causing a reduction in velocity of the fluid, a conversion of the kinetic energy in the fluid, and an increase in static pressure. Plug 110 is formed with a contour 134 that directs fluid from the exit of the diffuser into an annular zone 136, which is connected directly to the inlet ports of the pumping chamber.

Whereas, in a conventional pump of this type, low pressure fluid in a reservoir enters the pumping chambers at low or substantially zero pressure, the jet pump effect produced by high velocity stream of excess bypass fluid from the pressure relief valve combined with low pressure fluid returning from the power steering system supercharges fluid entering the pump inlet and increases the overall efficiency of the pump. Instead of dissipating kinetic energy in the stream of high pressure fluid produced when the pump operates at high speed by returning it to a low pressure reservoir, energy in that fluid stream is used first to draw fluid from the reservoir or return line into the high velocity stream. Then the combined fluid stream velocity is increased by passing the stream through a first contracting portion of the diffuser and increasing static pressure by allowing the high velocity fluid stream to expand through the diffuser and to be carried in the high pressure-low velocity to the inlet of the pumping chamber. Test results using this supercharging technique show that when the power steering system pressure is operating at approximately 85 psi, pressure in the fluid stream between the diffuser and the inlet to the pumping chambers is approximately 40 psi.

Figure 5:
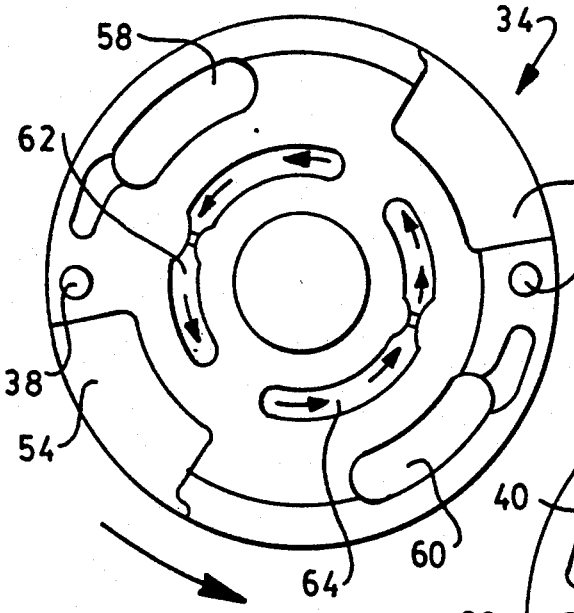
FIG. 5 is an end view of the lower plate showing the relative position of inlet and outlet ports, and passages to facilitate cold start priming.
Figure 6:
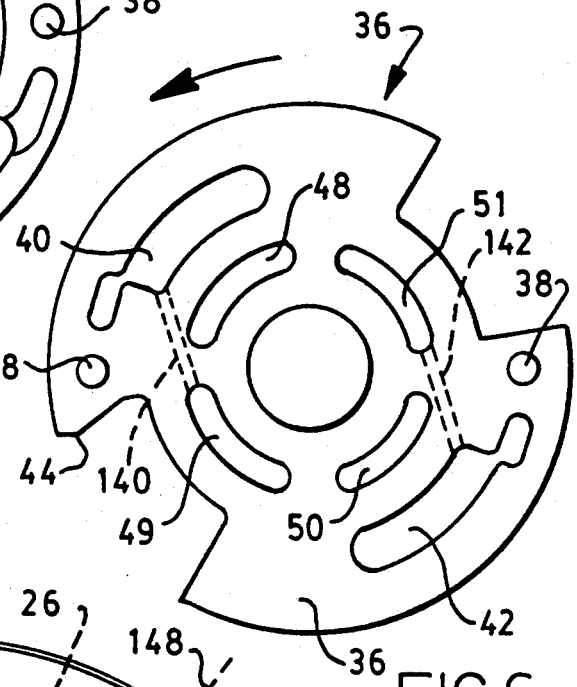
FIG. 6 is an end view of the upper pressure plate showing the relative angular and radial positions of the inlet and outlet ports and the passages communicating with those of the lower pressure plate through vane slots of the rotor.

Details of the pressure plates are shown in FIGS. 5 and 6. Lower pressure plate 34 has two diametrically opposite inlet ports 54, 56 and two diametrically opposite outlet ports 58, 60, each outlet port spaced approximately an equal angular distance from the inlet ports. Two arcuate, diametrically opposite channels 62, 64, located radially and angularly at a position to communicate with terminal holes at the radial base of the rotor slots, are formed in the face of the lower plate adjacent the rotor surface.

The upper pressure plate 36 includes inlet ports 44, 46 radially and angularly aligned with the corresponding inlet ports of the lower pressure plate, and outlet ports 40, 42 radially and angularly aligned with outlet ports 58, 60, respectively. The upper pressure plate has two pairs of passages 48, 49 and 50, 51 aligned angularly and radially with the terminal holes at the radially inner end of the rotor slots and with channels 62, 64, respectively, of the lower pressure plate. Cover 68 includes passages 140, 142, which connect passages 49 and 51 to the pump outlet ports 40 and 42, respectively.

Figure 7:
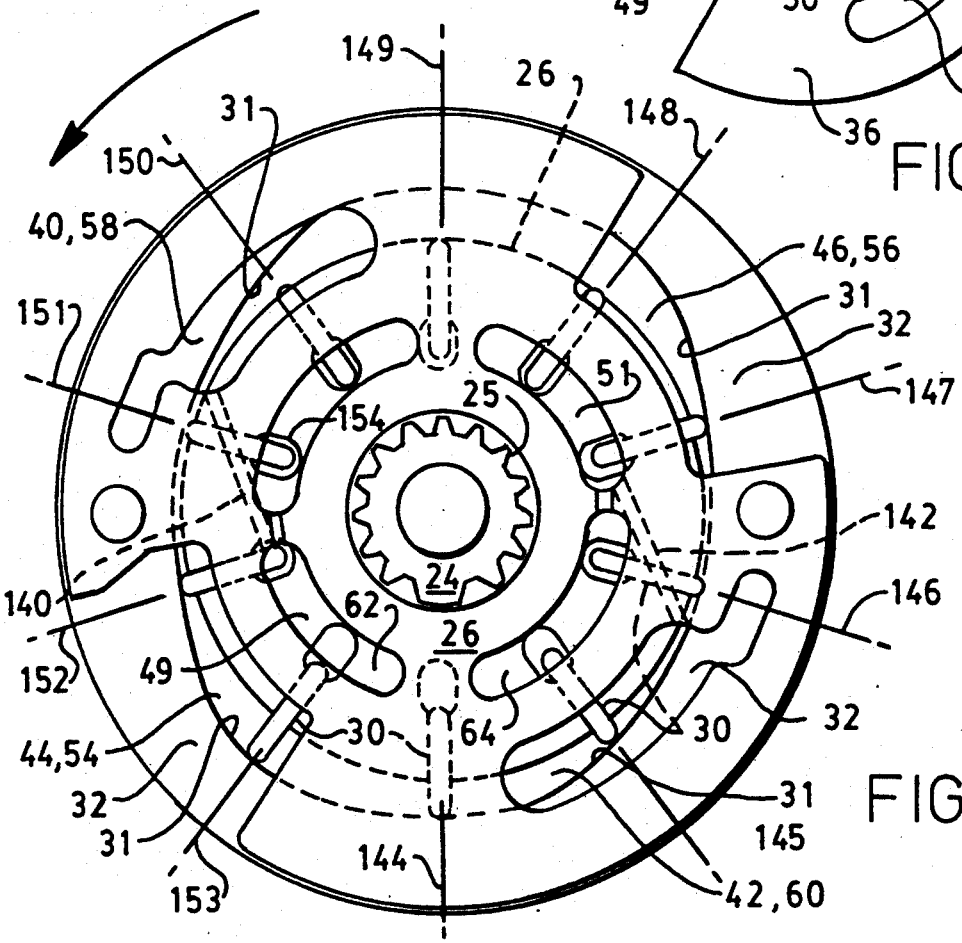
FIG. 7 is an end view superimposing the lower pressure plate, upper pressure plate, cam, rotor, vanes, and hydraulic passages connecting these.
Figure 11:
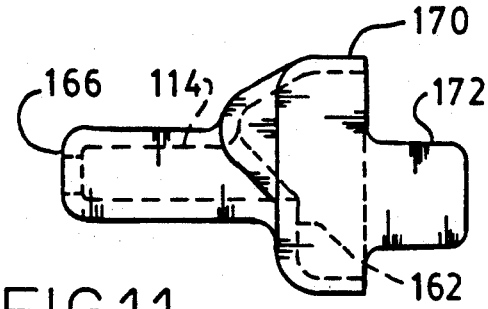
FIG. 11 is an end view of the orifice fitting.
Figure 12:
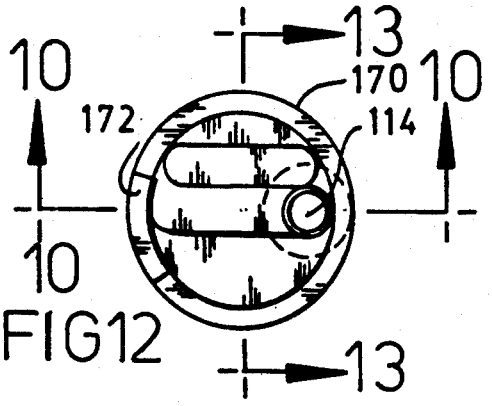
FIG. 12 is a side view of the fitting of FIG. 11.
Figure 13:
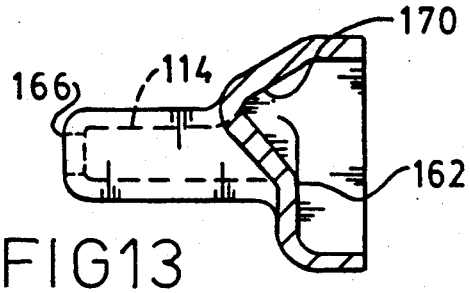
FIG. 13 is a cross section taken at plane XIII—XIII in FIG. 11.
Figure 10:
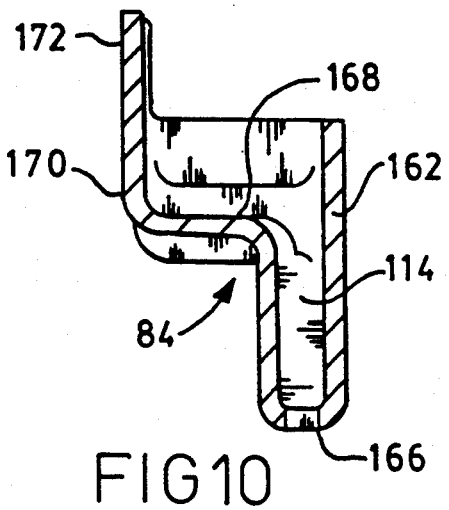
FIG. 10 is a cross section of the orifice fitting according to this invention taken at plane X—X of FIG. 11.

FIG. 7 shows ten rotor vanes 30 located within radially directed slots in each of ten locations 144-153. In normal operation, the radial tip of each vane contacts the inner surface 31 of cam 32 so that the vanes rise within the slots twice during each revolution and fall within the slots twice during each revolution. The vanes rise within inlet quadrants that include the inlet ports 44, 46, 54, 56; the vanes fall within outlet quadrants that include outlet ports 40, 42, 58, 60; the inlet quadrants being spaced mutually by an outlet quadrant. The radial end of each slot includes a terminal hole 154 extending through the axial thickness of the rotor and along a radial depth located so that each terminal hole passes over the arcuate passage 62, 64 of the lower pressure plate and the arcuate passages 48-51 of the upper pressure plate The terminal holes, therefore, connect hydraulically the passages of the lower pressure plate that are adjacent the lower surface of the rotor 26 and the passages of the upper pressure plate that are adjacent the upper surface of the rotor.

In operation, when rotor rotation stops, the vanes located above the horizontal center line of the rotor slide along the radial length of the slot toward the terminal hole, due to the effect of gravity, and the vanes below the horizontal center line remain in contact with the inner surface of the cam ring. The fit between the vanes and their slots is a close tolerance fit. At low temperature, the viscosity of the power steering fluid is large.

When a conventional power steering pump rotor is started with the vanes in this position and at low temperature, the vanes at positions 148-150 remain at the bottom of the slot and outlet passages 40, 58 are connected to the inlet passages 46, .56 because those vanes are not in contact with the cam surface. The tightness of the fit of the vanes within the slots and the viscosity of the fluid operate in opposition to the effect of centrifugal force tending to drive the vanes radially outward. However, as the rotor rotates counterclockwise as viewed in FIG. 7, hydraulic fluid in the terminal holes above those vanes in contact with the cam is displaced as each such vane falls within the slot as those vanes enter the fall or outlet quadrants. As the vanes fall, they force fluid present within the terminal holes and rotor slots toward passages 62, 64 in the lower plate. There is no flow toward the upper plate because passages 48, 50 are blind. Within passages 62, 64 flow is in the direction of rotation, i.e., toward the rise or inlet quadrant. Because ports 48, 50 are blind, the only connection across the rotor between passages 62, 64 and outlet passages 40, 42 is through the axial length of the terminal holes in the inlet quadrant where the vanes are attempting to rise in their slots. To reach the outlet passages 40, 42, fluid pumped from the vane slots in the fall or inlet quadrant then crosses the rotor through the terminal holes at the radial end of those slots located in the inlet quadrant, i.e., from passages 62, 64 of the lower plate to passages 49, 51 of the upper plate.

Fluid pumped from the vane slots and terminal holes by the vanes in the fall quadrants of the cam applies a pressure in the terminal hole urging vanes within the rise quadrants radially outward into contact with the cam surface. When viscosity and friction forces tending to hold vanes near the bottom of the rotor slots exceed forces tending to move the vane radially outward, the pressure below the vane in each slot is a maximum on the axial side of the rotor adjacent the lower pressure plate and declines due to pressure drop along the axial length of the rotor.

Figure 8:
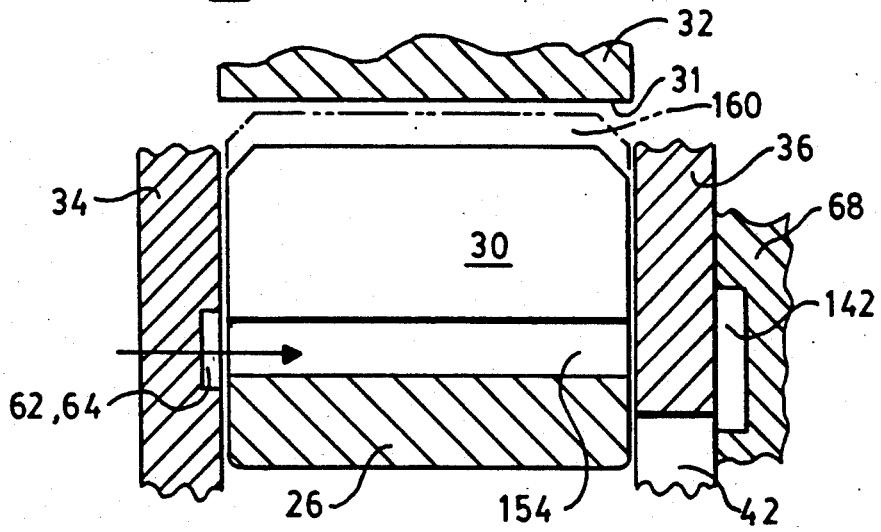
FIG. 8 is a partial cross section taken along the axis of the rotor shaft through the pressure plates rotor and cam.

An explanation of the hydraulic principles operating to cause all of the vanes of the pump to move outward into contact with the cam surface during a cold start condition is explained with reference to FIGS. 8 and 9. Fluid pumped by the vanes falling within their slots is pumped in the direction of rotor rotation across the axial length of the rotor through the terminal holes from the lower pressure plate to the blind ports of the upper pressure plate and then through passages 140, 142 in the cover to the outlet ports in the upper pressure plate. FIG. 8 shows the condition where a rotor vane is held at the bottom of the terminal hole due to friction and viscosity and has radially directed hydraulic pressure distributed along its length tending to move the vane outward in opposition to the forces holding the vane at the bottom of the terminal hole.

Figure 9:
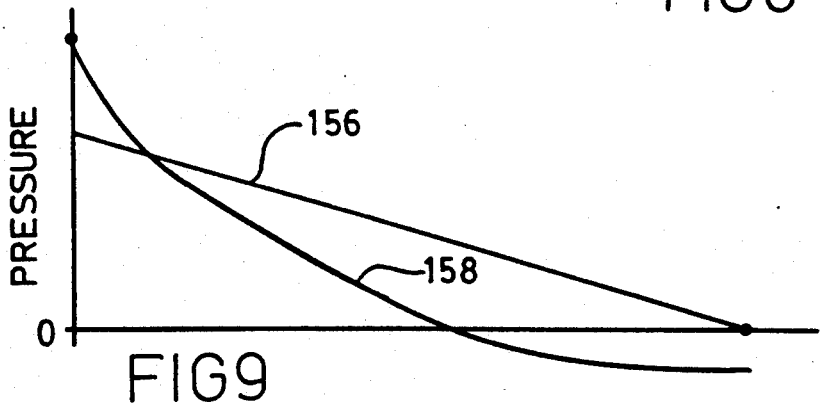
FIG. 9 is a graph representing the variation of pressure in the rotor vane slot along the axial length of the terminal hole.

Curve 156 in FIG. 9 represents the variation of pressure within the terminal hole between the upper pressure plate and the lower pressure plate. When the vane is located at the bottom of the terminal hole, a pressure drop results because of fluid friction associated with the high viscosity fluid along the axial length of the terminal hole 154. At the end of the terminal hole adjacent the upper pressure plate, the static pressure of the hydraulic fluid in the terminal hole will be substantially zero because the terminal hole at the upper pressure plate is connected by passage 142 to the outlet passage 42. Since vanes at positions 147, 148 and 149 are not contacting cam surface 31 but instead are located near the bottom of the slots, the outlet ports 40, 42, in the upper pressure plate are connected within the rotor to inlet ports 44, 46 where pressure is substantially atmospheric pressure. Curve 156 is inclined because of the pressure drop that occurs across the axial length of the vane as fluid is pumped through the terminal hole.

Pressure forces pumped by the falling vanes in the direction of rotation to the vanes within the rise quadrant of the cam tend to force those vanes radially outward. Curve 156 represents the variation of pressure in the terminal hole below the vanes as they begin to move from the terminal holes radially outward toward surface 31. A vane in the intermediate position 160, between a position at the bottom of the rotor slot and a position in contact with surface 31, is indicated in FIG. 8. Curve 158 shows a pressure drop along the length of the terminal hole from relatively high pressure within a terminal hole near the upper pressure plate and declining rapidly to a position between the pressure plates where pressure in the terminal hole passes through zero pressure and declines to a region of negative pressure as axial distance toward the upper plate increases. Negative pressure within the terminal hole causes fluid to flow from the interconnected inlet port 44, 46 and outlet ports 40, 42 through passages 140, 142 to the terminal hole 154. The volume of fluid flowing into each terminal hole is sufficient to refill the hole and is equal to the volume caused by the radially outward displacement of the vane.

This process is repeated when the vane passes again to the succeeding rise portion of the rotor between vane positions 152 and 153. Pressure continually increases within the terminal hole because fluid is pumped forward in the direction of rotation from the vane within the fall position, such as the vanes in positions 150, towards the vanes in the rise portion of the rotor at positions 152, 153 until vanes in the rise quadrant move radially outward into contact with the cam. Each time vanes that are not yet in contact with the cam move outward a portion of the distance toward the cam, volume displaced within the terminal hole is replaced with an equal volume of fluid flowing into the terminal hole below such a vane as previously described. This process continues with two such cycles in each rotor revolution until all of the vanes that have fallen to the bottom of their slots while the rotor was stopped have been driven outward into contact with surface 31 of the cam.

Referring to FIGS. 10-13, the orifice fitting 84 includes a cylinder 162 directed parallel to the axis of valve cylinder 14 having an aperture 114, a circular hole extending axially between ends 166, 168 of the cylinder. A flange 170 has a surface sized to engage the valve cylinder 14 with an interference fit, by which the orifice fitting is held in position. Tang 172, directed toward fitting 84, prevents contact of the valve with end 168 and closure of the aperture if fitting 84 moves along the valve cylinder.

Figure 14:
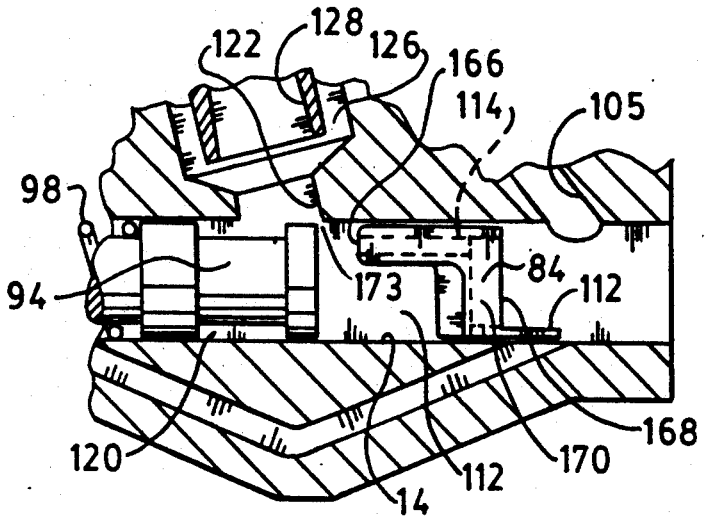
FIG. 14 is a partial cross section through the flow control valve and bypass diffuser showing a zone of pressure gradient near the orifice aperture and bypass port.

When bypass port 122 begins to open by moving to the position of FIG. 14, a steep pressure gradient occupies the local region adjacent bypass port opening 173. Pressure within that region varies from the high pressure generally present in valve cylinder 14 between pump outlet port 112 and end 166 of the aperture and the low pressure at the bypass port.

As the valve spool moves axially to open further the bypass port, the pressure gradient, from high pressure generally present in the valve cylinder to low pressure in the immediate vicinity of the bypass port, broadens in range across the end of the aperture, so that pressure at the aperture end face 166 is lower when the bypass port is closed or opened only slightly. When this occurs, pressure at the end of the aperture is lower than pressure elsewhere in the valve cylinder near the pump outlet 112. Pressure at the opposite end 168 of the aperture is lower when the bypass valve is closed or opened less far. Consequently, when the bypass is opened sufficiently so that pressure at end 166 is lower than at the pump outlet, pressure falls in feedback line 115 leading from the downstream end 168 of the aperture to the end of the valve spool contacted by spring 98. This reduces the force on the spool tending to close the bypass valve, thereby further opening the bypass port more than it would be if the aperture end were located distant from the bypass port or where pressure at the aperture end is greater and closer to pressure at the pump discharge port 112.

Figure 15:
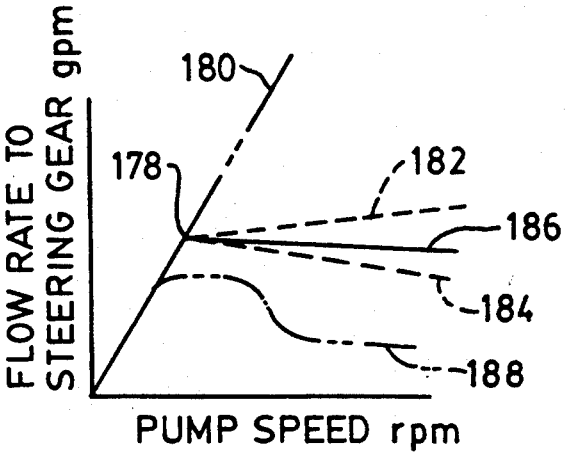
FIG. 15 is a graph showing the relation between fluid flow rate to a load and pump speed for a flow rate orifice located at various positions relative to a bypass port.

FIG. 15 shows graphically the effect of the location of the orifice aperture. The radial location of the aperture near the bypass port is located within the pressure gradient zone such that flow rate to the steering gear is abruptly changed at 178 in relation to pump speed after the bypass port first begins to open. When that port is closed, flow rate to the steering gear changes proportionally with pump speed, as shown at 180 in FIG. 15. After pump speed rises to a predetermined critical speed at 178, the linear relation to flow rate present at lower speeds changes to a much lower positive slope 182, or a shallow negative slope 184, or a constant flow rate 186, at all speeds above the critical speed 178.

The position of the aperture at end 166 in relation to the bypass port and to the pressure gradient near the bypass port is determined so that the desired relation between flow rate to the steering gear and pump speed above the critical speed results. For example, when the distance of the aperture from bypass port is small, flow rate above the critical speed tends toward constant or slightly negative slope at speeds above the speed of critical point 178. When the aperture is located further from the bypass port, flow rate tends toward slightly positive inclination.

The effect of a drooper pin is represented in FIG. 15 by line 188.

Having described a preferred embodiment of my invention, what I claim and desire to secure by U.S. Letters Patent is:

1. A flow control valve for controlling the flow rate of fluid from a fluid pressure source to a load, comprising:

a valve cylinder having a spool slidable therein having first and second pressure surfaces;

an outlet port through which fluid enters said valve cylinder, said outlet port communicating with the discharge side of the fluid pressure source and the first pressure surface;

a bypass port communicating with the valve cylinder, admitting therethrough fluid from the outlet port, opened and closed to said cylinder as said spool moves in said cylinder;

orifice means hydraulically connecting the outlet port and the load, having an inlet end thereof located eccentric of the longitudinal axis of the valve cylinder adjacent the bypass port and an outlet end thereof connected to the load; and a pressure feedback passage connecting the outlet end of the orifice means and the second pressure surface.

2. The valve of claim 1 further comprising:

a spring urging the spool toward a position where the bypass port is opened; and the spool having first and second pressure surfaces facing opposite axial directions, a force due to pressure on the first pressure force tending to open the bypass port and a force due to pressure on the second pressure force tending to close the bypass port.

3. The valve of claim 1 further comprising a source of low pressure fluid, and wherein the bypass port connects the valve cylinder and said source of low pressure when the bypass port opens in response to movement of said spool along the axis of said valve cylinder.

4. The valve of claim 1 further comprising:

a spring urging the spool toward a position where the bypass port is opened;

the spool having first and second pressure surfaces facing opposite axial directions, a force due to pressure on the first pressure force tending to open the bypass port and a force due to pressure on the second pressure force tending to close the bypass port; and a source of low pressure fluid, and wherein the bypass port connects the valve cylinder and said source of low pressure when the bypass port opens in response to movement of said spool along the axis of said valve cylinder.

5. The valve of claim 1 wherein the bypass port intersects the valve cylinder and extends along the length of the valve cylinder between axially spaced edges formed by said intersection, the spool further comprising a control surface movable along the cylinder across the bypass port as said spool moves along the axis of said valve cylinder, the control surface closely fitting within the valve cylinder so that the control surface seals the valve cylinder against passage of fluid, the control surface first opening the bypass port as the control surface moves past an edge of the bypass port at one axial end thereof.

6. The valve of claim 5 further comprising:

a spring urging the spool toward a position where the bypass port is opened; and the spool having first and second pressure surfaces facing opposite axial directions, a force due to pressure on the first pressure force tending to open the bypass port and a force due to pressure on the second pressure force tending to close the bypass port.

7. The valve of claim 5 further comprising a source of low pressure fluid, and wherein the bypass port connects the valve cylinder and said source of low pressure when the bypass port opens in response to movement of said spool along the axis of said valve cylinder.

8. The valve of claim 7 further comprising:

a spring urging the spool toward a position where the bypass port is opened; and the spool having first and second pressure surfaces facing opposite axial directions, a force due to pressure on the first pressure force tending to open the bypass port and a force due to pressure on the second pressure force tending to close the bypass port.

9. The valve of claim 1 wherein the orifice means includes a surface having a contour, a portion of which is similar to the contour of the valve cylinder, said surface having an interference fit with the surface of the cylinder, said interference fit operating to hold the orifice means in position in the valve cylinder.

10. The valve of claim 5 wherein the inlet end of the orifice means is located in the valve cylinder adjacent the edge of the bypass port that is first opened by the control surface.

11. The valve of claim 4 wherein the control surface closes the inlet end of the orifice means as the spool moves into abutting contact with the orifice means.

12. A orifice fitting for producing a fluid pressure drop between a source of fluid pressure in a control valve and a load supplied with pressurized fluid from the control valve, comprising:

mounting surface means for locating the orifice fitting within the control valve; and a cylinder having an aperture extending axially therethrough, an inlet end located eccentric of the longitudinal axis of the valve and an outlet end located at the axially opposite end of the cylinder.

13. The orifice fitting of claim 12 wherein the mounting surface means includes a surface having a contour concentric with the contour of the inner surface of the valve, said mounting surface means having an interference fit with the inner surface of the valve, said interference fit operating to hold the orifice means in position in the valve.

14. A flow control system for controlling the flow rate of fluid to a load, comprising:

a fluid pump having a discharge and an inlet;

valve means having a first pressure surface, a second pressure surface hydraulically connected to the discharge of the pump, for controlling fluid flow to the load in response to differential pressure across the first and second pressure surfaces;

bypass means opened and closed by the valve means, for directing fluid from the pump discharge to the pump inlet;

an orifice fitting hydraulically connecting the pump discharge and the load, said fitting comprising:

mounting surface means for locating the orifice fitting within the valve means; and a cylinder having an aperture extending axially therethrough, an inlet end located eccentric of the longitudinal axis of the valve and an outlet end located at the axially opposite end of the cylinder, said inlet located in a zone adjacent the bypass port wherein a pressure gradient from relatively high pressure of the pump discharge and relatively low pressure of the pump inlet exists the location of the aperture inlet being located where the magnitude of pressure of lower than pressure at the pump discharge; and a pressure feedback passage connecting the outlet end of the orifice means and the second pressure surface.

* * * * *